US012151850B1

(12) United States Patent
Smith

(10) Patent No.: US 12,151,850 B1
(45) Date of Patent: Nov. 26, 2024

(54) DUAL COMPARTMENT DRINKING VESSEL

(71) Applicant: Frank Smith, Brooklyn, NY (US)

(72) Inventor: Frank Smith, Brooklyn, NY (US)

( * ) Notice: Subject to any disclaimer, the term of this patent is extended or adjusted under 35 U.S.C. 154(b) by 254 days.

(21) Appl. No.: 17/880,016

(22) Filed: Aug. 3, 2022

(51) Int. Cl.

| | |
|---|---|
| ***B65D 1/04*** | (2006.01) |
| ***B65D 25/04*** | (2006.01) |
| ***B65D 25/28*** | (2006.01) |
| ***B65D 41/04*** | (2006.01) |
| ***B65D 81/38*** | (2006.01) |

(52) U.S. Cl.
CPC ..... *B65D 25/04* (2013.01); *B65D 25/2861* (2013.01); *B65D 41/04* (2013.01); *B65D 81/3837* (2013.01); *B65D 2205/02* (2013.01); *B65D 2231/022* (2013.01)

(58) Field of Classification Search
CPC ..... B65D 1/04; B65D 2231/022; B65D 2205/02; B65D 81/3837; B65D 41/04; B65D 25/04; B65D 25/2861
USPC ..... 222/129–144.5
See application file for complete search history.

(56) References Cited

U.S. PATENT DOCUMENTS

| | | | | | |
|---|---|---|---|---|---|
| 3,197,071 | A * | 7/1965 | Kuster | B65D 81/325 | 222/105 |
| 3,467,269 | A * | 9/1969 | Newton | B65D 1/04 | 220/500 |
| D395,790 | S * | 7/1998 | Gaines | D7/510 | |
| 5,934,501 | A * | 8/1999 | Wright | B65D 1/265 | 220/528 |
| 6,179,146 | B1 * | 1/2001 | Betras | B65D 47/06 | 215/229 |
| 7,975,868 | B1 * | 7/2011 | Flies | B65D 1/265 | 220/524 |
| 8,240,497 | B2 * | 8/2012 | Kountotsis | B65D 1/04 | 220/717 |
| 8,844,316 | B1 | 9/2014 | Ademola | | |
| D722,828 | S | 2/2015 | Shamoon | | |
| D760,543 | S | 7/2016 | Lue | | |
| 9,718,582 | B2 | 8/2017 | Hylton | | |
| D830,775 | S * | 10/2018 | Lewis | D7/510 | |
| D895,362 | S | 9/2020 | Lue | | |
| 2005/0161424 | A1 * | 7/2005 | Hogan | B65D 1/04 | 215/10 |
| 2009/0188929 | A1 | 7/2009 | Sims | | |

(Continued)

FOREIGN PATENT DOCUMENTS

WO 2011099864 8/2011

*Primary Examiner* — Charles P. Cheyney

(57) ABSTRACT

The dual compartment drinking vessel is configured for use with a plurality of beverages. The dual compartment drinking vessel contains the plurality of beverages. The dual compartment drinking vessel comprises a plurality of bottles, an exterior housing, and a strap structure. The exterior housing contains the plurality of bottles. The strap structure attaches to the exterior housing. The plurality of bottles contains the plurality of beverages. Each bottle selected from the plurality of bottles is a segregated structure. Each beverage selected from the plurality of beverages is contained in a bottle selected from the plurality of bottles. Each bottle selected from the plurality of bottles is an isolated structure. Each bottle selected from the plurality of bottles is an insulating structure that prevents the transfer of heat between any two beverages selected from the plurality of beverages.

13 Claims, 4 Drawing Sheets

(56) References Cited

U.S. PATENT DOCUMENTS

| | | | | |
|---|---|---|---|---|
| 2010/0078436 | A1* | 4/2010 | Winchell | B65D 47/046<br>220/709 |
| 2010/0116769 | A1* | 5/2010 | Kountotsis | B65D 1/0292<br>215/6 |
| 2013/0001111 | A1 | 1/2013 | Knutsen | |
| 2015/0144516 | A1* | 5/2015 | Shamoon | B65D 25/04<br>206/459.1 |
| 2016/0200474 | A1 | 7/2016 | Burden | |
| 2021/0269195 | A1 | 9/2021 | Burden | |

* cited by examiner

DUAL COMPARTMENT DRINKING VESSEL

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of containment structures formed with partitions. (B65D25/04)

SUMMARY OF INVENTION

The dual compartment drinking vessel is configured for use with a plurality of beverages. The dual compartment drinking vessel contains the plurality of beverages. The dual compartment drinking vessel comprises a plurality of bottles, an exterior housing, and a strap structure. The exterior housing contains the plurality of bottles. The strap structure attaches to the exterior housing. The plurality of bottles contains the plurality of beverages. Each bottle selected from the plurality of bottles is a segregated structure. Each beverage selected from the plurality of beverages is contained in a bottle selected from the plurality of bottles. Each bottle selected from the plurality of bottles is an isolated structure that isolates the beverage contained in the selected bottle from the beverages remaining in the plurality of beverages. Each bottle selected from the plurality of bottles is an insulating structure that prevents the transfer of heat between any two beverages selected from the plurality of beverages.

These together with additional objects, features and advantages of the dual compartment drinking vessel will be readily apparent to those of ordinary skill in the art upon reading the following detailed description of the presently preferred, but nonetheless illustrative, embodiments when taken in conjunction with the accompanying drawings.

In this respect, before explaining the current embodiments of the dual compartment drinking vessel in detail, it is to be understood that the dual compartment drinking vessel is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the dual compartment drinking vessel.

It is therefore important that the claims be regarded as including such equivalent construction insofar as they do not depart from the spirit and scope of the dual compartment drinking vessel. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
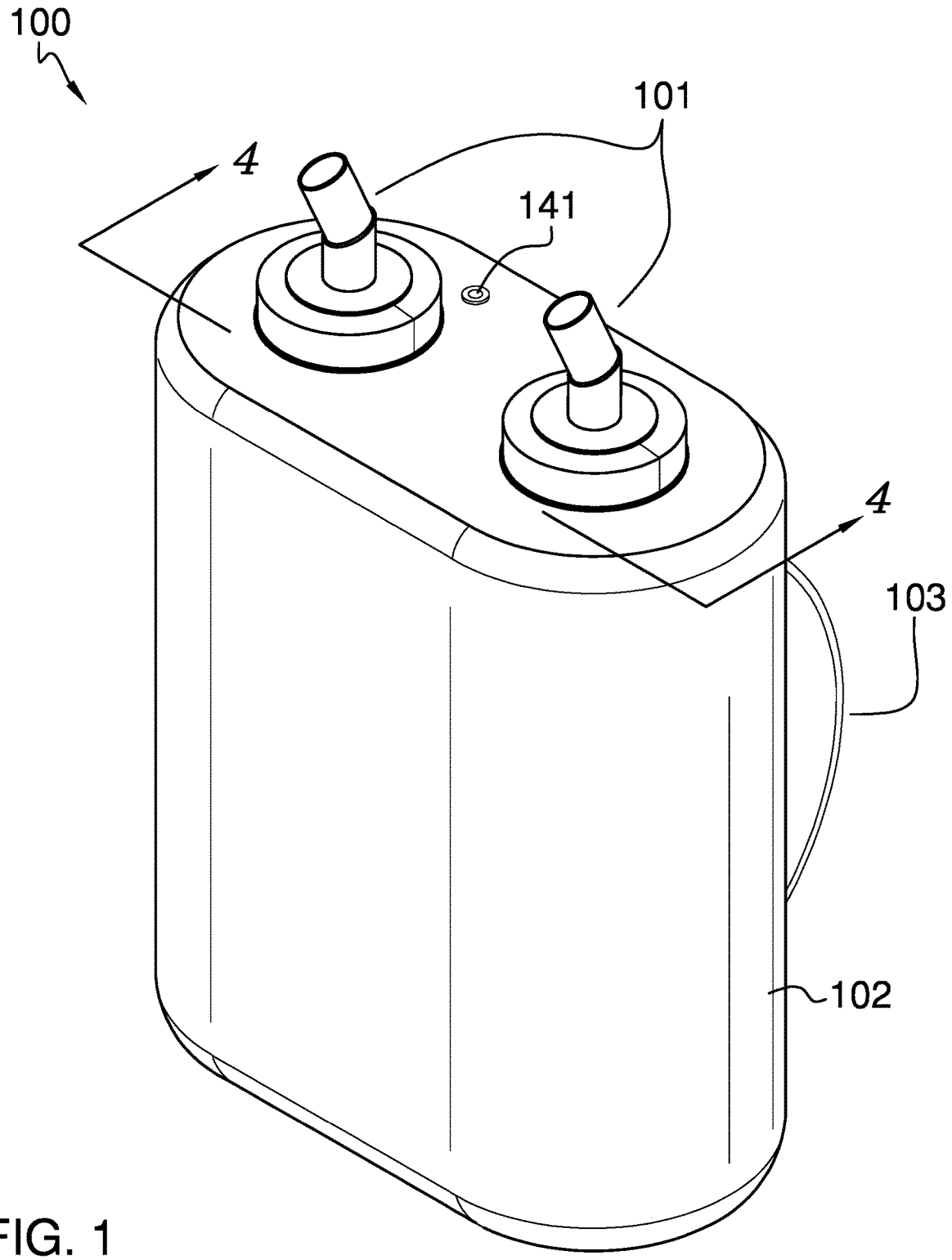
FIG. 1 is a perspective view of an embodiment of the disclosure.
Figure 2:
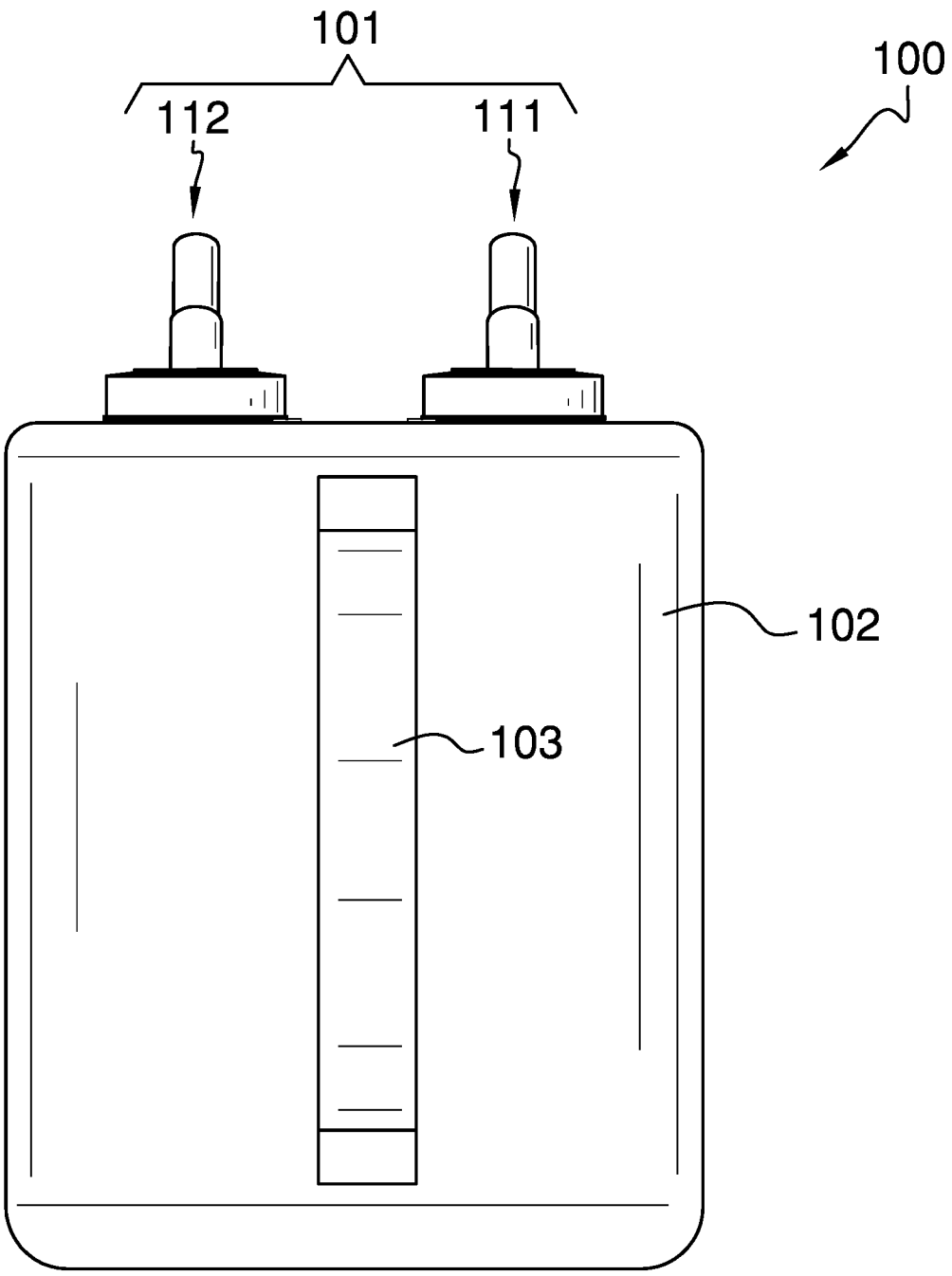
FIG. 2 is a rear view of an embodiment of the disclosure.
Figure 3:
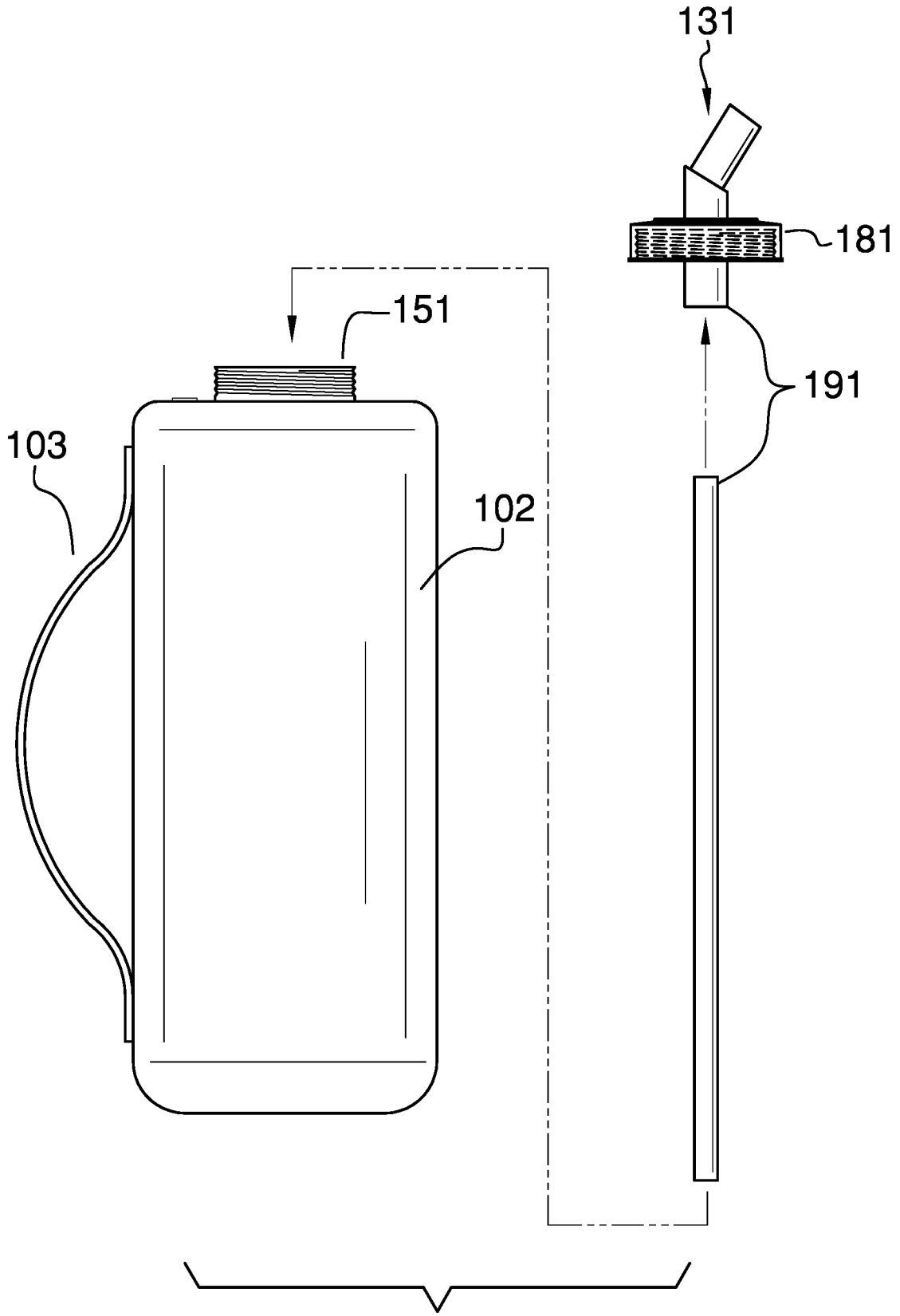
FIG. 3 is a side view of an embodiment of the disclosure.
Figure 4:
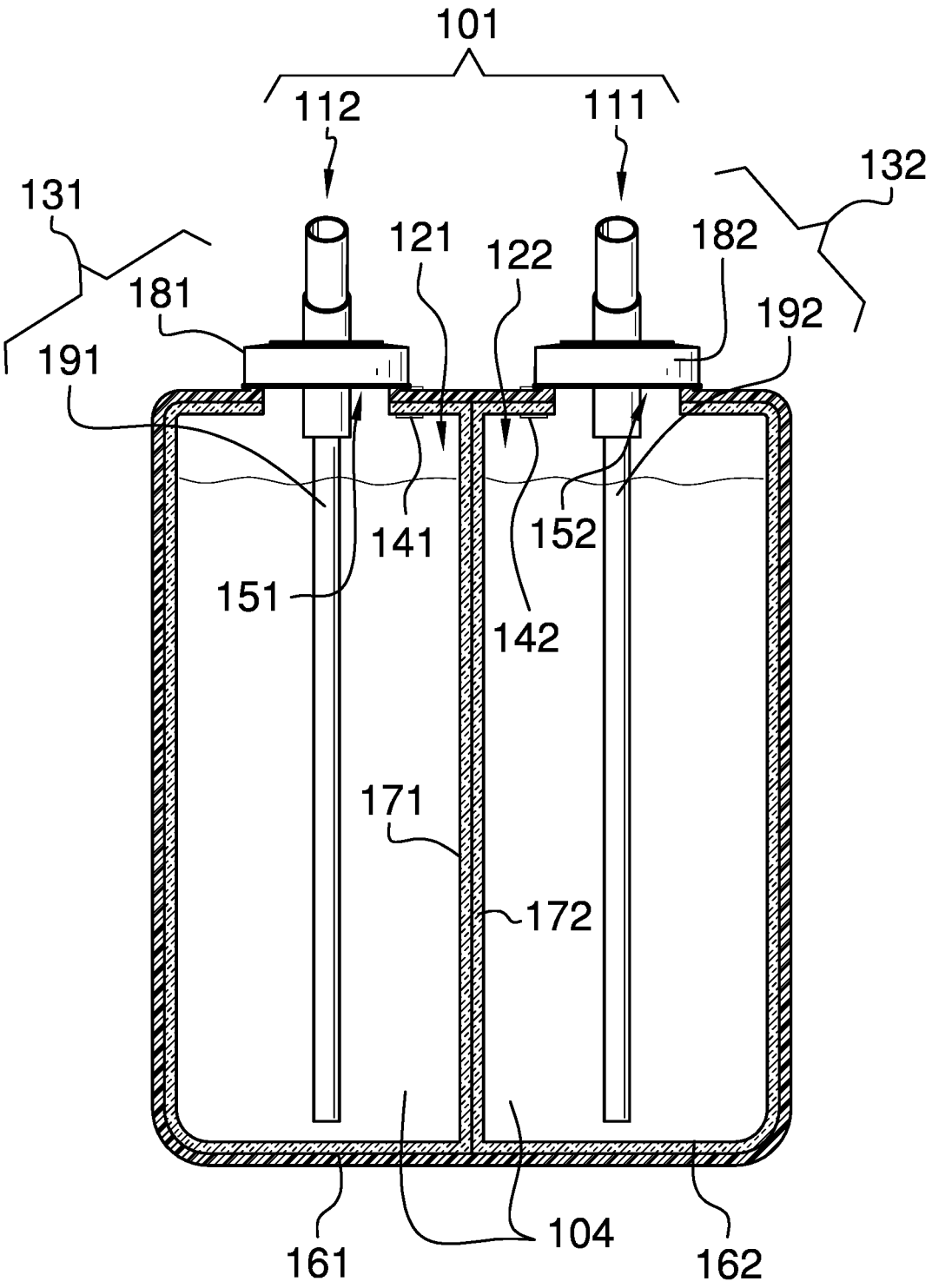
FIG. 4 is a cross-sectional view of an embodiment of the disclosure across 4-4 as shown in FIG. 1.

Detailed reference will now be made to one or more potential embodiments of the disclosure, which are illustrated in FIGS. 1 through 4.

The dual compartment drinking vessel 100 (hereinafter invention) is configured for use with a plurality of beverages 104. The invention 100 contains the plurality of beverages 104. The invention 100 comprises a plurality of bottles 101, an exterior housing 102, and a strap structure 103. The exterior housing 102 contains the plurality of bottles 101. The strap structure 103 attaches to the exterior housing 102. The plurality of bottles 101 contains the plurality of beverages 104. Each bottle selected from the plurality of bottles 101 is a segregated structure. Each beverage selected from the plurality of beverages 104 is contained in a bottle selected from the plurality of bottles 101. Each bottle selected from the plurality of bottles 101 is an isolated structure that isolates the beverage contained in the selected bottle from the beverages remaining in the plurality of beverages 104. Each bottle selected from the plurality of bottles 101 is an insulating structure that prevents the transfer of heat between any two beverages selected from the plurality of beverages 104.

The exterior housing 102 is a rigid structure. The exterior housing 102 contains and encloses the plurality of bottles 101. The strap structure 103 attaches to the exterior surface of the exterior housing 102. The exterior housing 102 is formed with all apertures and form factors necessary to allow the exterior housing 102 to accommodate the use of the plurality of bottles 101. The exterior housing 102 is an insulating structure. The exterior housing 102 prevents the exchange of heat between the environment surrounding the exterior housing 102 and the plurality of beverages 104 contained within the plurality of bottles 101.

The strap structure 103 is a mechanical structure. The strap structure 103 forms a handle used to carry the invention 100.

The plurality of bottles 101 forms the containment structure that stores the plurality of beverages 104. Each bottle selected from the plurality of bottles 101 is a fluid impermeable structure. Each selected bottle contains a beverage selected from the plurality of beverages 104. Each selected bottle isolates its associated selected beverage from the beverages remaining in the plurality of beverages 104. Each selected bottle is an insulating structure. Each bottle selected from the plurality of bottles 101 inhibits the exchange of heat between any two beverages selected from the plurality of beverages 104. The plurality of bottles 101 comprises a first bottle 111 and a second bottle 112.

The first bottle 111 is a fluid containment structure selected from the plurality of bottles 101. The first bottle 111 is a fluid impermeable structure. The first bottle 111 is a prism shaped structure. The first bottle 111 contains a first beverage selected from the plurality of beverages 104. The first bottle 111 is an isolating structure that isolates the first beverage from a second beverage contained in the second bottle 112. The first bottle 111 is an insulating structure. The first bottle 111 prevents the exchange of heat between the first beverage contained in the first bottle 111 and the second beverage contained in the second bottle 112. The first bottle 111 attaches to the second bottle 112 to form a single lateral prism structure. The first bottle 111 comprises a first flask 121, a first cap structure 131, and a first vent 141.

The first flask 121 is a pan structure. The first flask 121 is a fluid impermeable structure. The first flask 121 forms the containment structure of the first bottle 111. The first flask 121 contains the first beverage within the first bottle 111. The first flask 121 further comprises a first neck 151, a first closed congruent end 161, and a first lateral face structure 171.

The first neck 151 is the structure that forms the open face of the pan structure of the first flask 121. The first cap structure 131 inserts into the first flask 121 through the first neck 151. The first beverage enters the first flask 121 through the first neck 151.

The first closed congruent end 161 is the closed face of the pan structure of the first flask 121. The first closed congruent end 161 forms a portion of the containment surfaces that contain the first beverage within the first flask 121.

The first lateral face structure 171 is the lateral face structure of the first flask 121. The first lateral face structure 171 forms the balance of the containment surfaces that contain the first beverage within the first flask 121.

The first cap structure 131 is sealing structure. The first cap structure 131 encloses the first neck 151 of the first flask 121. The first cap structure 131 forms a fluid transport device that allows the first beverage to be dispensed from the first flask 121 through suction. The first cap structure 131 further comprises a first cap structure 181 and a first straw 191.

The first cap structure 181 forms a bottle cap that encloses the first neck 151 of the first flask 121. The first cap structure 181 attaches to the first neck 151 using a threaded connection.

The first straw 191 is a flexible tubular structure. The first straw 191 attaches to the first cap structure 181. The first straw 191 inserts through the first cap structure 181. The first straw 191 forms a fluidic connection between the first beverage contained in the first flask 121 and the exterior of the invention 100. The first straw 191 forms a fluid transport device that allows the first beverage to be drawn out of the first flask 121 for consumption. An externally provided suction provides the motive force that draws the first beverage through the first straw 191.

The first vent 141 is a fluid port. The first vent 141 forms a fluidic connection between the interior containment space of the first flask 121 and the exterior atmosphere. The first vent 141 equalizes the pressure between the external atmosphere and the gas contained in the first flask 121 to prevent a pressure differential that could lock the first beverage within the first bottle 111.

The second bottle 112 is a fluid containment structure selected from the plurality of bottles 101. The second bottle 112 is a fluid impermeable structure. The second bottle 112 is a prism shaped structure. The second bottle 112 contains the second beverage selected from the plurality of beverages 104. The second bottle 112 is an isolating structure that isolates the second beverage from the first beverage contained in the first bottle 111. The second bottle 112 is an insulating structure. The second bottle 112 prevents the exchange of heat between the second beverage contained in the second bottle 112 and the first beverage contained in the first bottle 111. The second bottle 112 attaches to the first bottle 111 to form a single lateral prism structure. The second bottle 112 comprises a second flask 122, a second cap structure 132, and a second vent 142.

The second flask 122 is a pan structure. The second flask 122 is a fluid impermeable structure. The second flask 122 forms the containment structure of the second bottle 112. The second flask 122 contains the second beverage within the second bottle 112. The second flask 122 further comprises a second neck 152, a second closed congruent end 162, and a second lateral face structure 172.

The second neck 152 is the structure that forms the open face of the pan structure of the second flask 122. The second cap structure 132 inserts into the second flask 122 through the second neck 152. The second beverage enters the second flask 122 through the second neck 152.

The second closed congruent end 162 is the closed face of the pan structure of the second flask 122. The second closed congruent end 162 forms a portion of the containment surfaces that contain the first beverage within the second flask 122.

The second lateral face structure 172 is the lateral face 8 structure of the second flask 122. The second lateral face structure 172 forms the balance of the containment surfaces that contain the second beverage within the second flask 122. The second lateral face structure 172 attaches to the first lateral face structure 171 to form the lateral prism structure of the plurality of bottles 101.

The second cap structure 132 is sealing structure. The second cap structure 132 encloses the second neck 152 of the second flask 122. The second cap structure 132 forms a fluid transport device that allows the second beverage to be dispensed from the second flask 122 through suction. The second cap 19 structure 132 further comprises a second cap structure 182 and a second straw 192.

The second cap structure 182 forms a bottle cap that encloses the second neck 152 of the second flask 122. The second cap structure 182 attaches to the second neck 152 using a threaded connection.

The second straw 192 is a flexible tubular structure. The second straw 192 attaches to the second cap structure 182. The second straw 192 inserts through the second cap structure 182. The second straw 192 forms a fluidic connection between the second beverage contained in the second flask 122 and the exterior of the invention 100. The second straw 192 forms a fluid transport device that allows the second beverage to be drawn out of the second flask 122 for consumption. An externally provided suction provides the motive force that draws the second beverage through the second straw 192.

The second vent 142 is a fluid port. The second vent 142 forms a fluidic connection between the interior containment space of the second flask 122 and the exterior atmosphere. The second vent 142 equalizes the pressure between the external atmosphere and the gas contained in the second flask 122 to prevent a pressure differential that could lock the second beverage within the second bottle 112.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Barrier: As used in this disclosure, a barrier is a physical obstacle that forms a boundary between a first space and a second space. The barrier prevents the passage of an object between the first space and the second space.

Beverage: As used in this disclosure, a beverage is a liquid that is intended for consumption by a person. Beverages are stored in a container selected from the group consisting of a bottle and a can.

Bottle: As used in this disclosure, a bottle is a container used for the storage of fluids. A bottle generally comprises a flask and a neck. The flask is a pan shaped containment structure. The neck is a tubular structure that provides access to the interior of the flask. The neck comprises: a) a tube structure that forms an aperture through which fluids can be introduced and removed from the bottle; and, b) a physical structure that encloses the open face of the pan structure of the flask such that the inner dimension of the neck need not be identical to the inner dimension of the flask.

Bottle Cap: As used in this disclosure, a bottle cap refers to a lid that is used to enclose the open neck of a bottle. A disposable bottle cap refers to a bottle cap that must be pried off of the neck of the bottle. A reusable bottle cap refers to a bottle cap that attaches to the neck of the bottle using a threaded connection.

Cant: As used in this disclosure, a cant is an angular deviation from one or more reference lines (or planes) such as a vertical line (or plane) or a horizontal line (or plane).

Cap: As used in this disclosure, a cap is a protective structure that encloses a space, opening, or fitting.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Chamber: As used in this disclosure, a chamber is an enclosed or enclosable negative space that is dedicated to a purpose.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Container: As used in this disclosure, a container is a structure that forms a protected space (or protection space) used to store and transport an object. The term containment structure is a synonym for container.

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Exterior: As used in this disclosure, the exterior is used as a relational term that implies that an object is not contained within the boundary of a structure or a space.

Fitting: As used in this disclosure, a fitting is a component that attaches a first object to one or more additional objects. The fitting is often used to forming a fluidic connection between the first object and the one or more additional objects.

Flow: As used in this disclosure, a flow refers to the passage of a fluid past a fixed point. This definition considers bulk solid materials as capable of flow.

Fluid: As used in this disclosure, a fluid refers to a state of matter wherein the matter is capable of flow and takes the shape of a container it is placed within. The term fluid commonly refers to a liquid or a gas.

Fluid Impermeable: As used in this disclosure, the term fluid impermeable refers to: a) the ability of a structure to not allow a fluid to pass through the structure; or, b) the ability of a material not absorb through the exterior surfaces of the material a fluid that the material is immersed in or exposed to.

Fluidic Connection: As used in this disclosure, a fluidic connection refers to a tubular structure that transports a fluid from a first object to a second object. Methods to design and use fluidic connections are well-known and documented in the mechanical, chemical, and plumbing arts.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Gas: As used in this disclosure, a gas refers to a state (phase) of matter that is fluid and that fills the volume of the structure that contains it. Stated differently, the volume of a gas always equals the volume of its container.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Heat Transfer: As used in this disclosure, heat transfer refers an exchange of thermal energy between a first object and a second object. In thermodynamics the first and second objects are often referred to as systems. This disclosure assumes that heat transfer occurs through three mechanisms: conduction, convection, and radiation. By conduction is meant that the heat is exchanged through the contact between the first object and the second object which facilitates the direct transfer of the energy of the vibration of the molecules of the first object to the molecules of the second object. By convection is meant that the heat is transferred through the exchange or movement of mass within and between the first object and the second object. By radiation is meant the transfer of heat energy in the form of (typically electromagnetic) waves between the first object and the second object.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Housing: As used in this disclosure, a housing is a rigid structure that encloses and protects one or more devices.

Inferior: As used in this disclosure, the term inferior refers to a directional reference that is parallel to and in the same direction as the force of gravity when an object is positioned or used normally.

Interior: As used in this disclosure, the interior is used as a relational term that implies that an object is contained within the boundary of a structure or a space.

Isolate: As used in this disclosure, to isolate means to keep or maintain a first object separate from a second object. The term isolate can also be applied to concepts.

Isolating Structure: As used in this disclosure, an isolating structure is an apparatus or device that isolates a first object from a second object such that the actions of the second object do not impact the intended purpose or function of the first object.

Insulating Material: As used in this disclosure, an insulating material is a material that inhibits, and ideally prevents, the transfer of heat through the insulating material. Insulating materials may also be used to inhibit or prevent the transfer of sound or the conduction of electricity through the insulating material. Methods to form insulating materials include, but are not limited to: a) the use of materials with low thermal conductivity; b) the use of materials with low electrical conductivity (or high resistivity); and, c) the use of a structural design that places a vacuum within the insulating material within the anticipated transfer path of the heat, sound, or electric current flow.

Insulating Structure: As used in this disclosure, an insulating structure is a structure that inhibits, and ideally prevents, the transfer of heat through the insulating structure. Insulating structures may also be used to inhibit or prevent the transfer of sound through the insulating structure. Methods to form insulating structures include, but are not limited to: 1) the use of materials with low thermal conductivity; and, 2) the use of a structural design that places a vacuum within the insulating structure within the anticipated transfer path of the heat or sound.

Lateral Disk Structure: As used in this disclosure, a lateral disk structure refers to the juxtaposition of a first lateral face of a first disk-shaped structure to a second lateral face of a second disk-shaped structure such that: a) the center axes of the first disk and the second disk are parallel; and, b) the congruent ends of the first disk are parallel to the congruent ends of the second disk. The span of the length of the center axes of the first disk and the second disk need not be equal. The form factor of the congruent ends of the first disk and the second disk need not be geometrically similar.

Lateral Prism Structure: As used in this disclosure, a lateral prism structure refers to the juxtaposition of a first lateral face of a first prism structure to a second lateral face of a second prism structure such that: a) the center axes of the first prism and the second prism are parallel; and, b) the congruent ends of the first prism are parallel to the congruent ends of the second prism. The span of the length of the center axes of the first prism and the second prism need not be equal. The form factor of the congruent ends of the first prism and the second prism need not be geometrically similar.

Liquid: As used in this disclosure, a liquid refers to a state (phase) of matter that is fluid and that maintains, for a given pressure, a fixed volume that is independent of the volume of the container.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Negative Space: As used in this disclosure, negative space is a method of defining an object through the use of open or empty space as the definition of the object itself, or, through the use of open or empty space to describe the boundaries of an object.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan are open.

Perimeter: As used in this disclosure, a perimeter is one or more curved or straight lines that bounds an enclosed area on a plane or surface. The perimeter of a circle is commonly referred to as a circumference.

Phase: As used in this disclosure, phase refers to the state of the form of matter. The common states of matter are solid, liquid, gas, and plasma.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Protected Space: As used in this disclosure, a protected space is a negative space within which an object is stored. The protected space is enclosed by a barrier structure that: a) prevents damage to the object contained within the protected space; b) maintains an environment suitable within the protected space that is appropriate for the object; protects the object within the protected space from potential dangers that are outside of the protected space; or, d) maintaining the privacy of the object within the protected space.

Rigid Structure: As used in this disclosure, a rigid structure is a solid structure formed from an inelastic material that resists changes in shape. A rigid structure will permanently deform as it fails under a force. See bimodal flexible structure.

Segregated Space: As used in this disclosure, a segregated space refers to a first negative space that does not overlap with a second negative space. By overlap is meant that that the first negative space and a second negative space do not share any common spaces. As a practical matter, when two negative spaces are formed such that a fluid will not flow between the two negative spaces, the two negative spaces can be considered segregated.

Solid: As used in this disclosure, a solid refers to a state (phase) of matter that: 1) has a fixed volume; and, 2) does not flow.

Strap: As used in this disclosure a strap is a strip of leather, cloth, or other flexible material, often with a buckle, that is used to fasten, secure, carry, or hold onto something.

Strip: As used in this disclosure, the term describes a long and narrow object of uniform thickness that appears thin relative to the length of the object. Strips are often rectangular in shape.

Straw: As used in this disclosure, a straw refers to a tubular structure used to transport a liquid foodstuff from a container.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

Temperature: As used in this disclosure, temperature refers to a relative measure of the kinetic and vibrational energy contained in the atoms and molecules of a first object (or system) relative to the kinetic and vibrational energy contained in the atoms and molecules of a second object (or system). When two objects (or systems) are in thermal equilibrium, the temperature of the two objects (or systems) is the same.

Threaded Connection: As used in this disclosure, a threaded connection is a type of fastener that is used to join a first cylindrical object and a second cylindrical object together. The first cylindrical object is fitted with a first fitting selected from an interior screw thread or an exterior screw thread. The second cylindrical object is fitted with the remaining screw thread. The cylindrical object fitted with the exterior screw thread is placed into the remaining cylindrical object such that: 1) the interior screw thread and the exterior screw thread interconnect; and, 2) when the cylindrical object fitted with the exterior screw thread is rotated the rotational motion is converted into linear motion that moves the cylindrical object fitted with the exterior screw thread either into or out of the remaining cylindrical object. The direction of linear motion is determined by the direction of rotation.

Tube: As used in this disclosure, a tube is a hollow prism-shaped device formed with two open congruent ends. The tube is used for transporting liquids (including bulk solids) and gases. The line that connects the center of the first congruent face of the prism to the center of the second congruent face of the prism is referred to as the center axis of the tube or the centerline of the tube. When two tubes share the same centerline they are said to be aligned. When the centerlines of two tubes are perpendicular to each other, the tubes are said to be perpendicular to each other. In this disclosure, the terms inner dimensions of a tube and outer dimensions of a tube are used as they would be used by those skilled in the plumbing arts.

Vacuum: As used in this disclosure, vacuum is used to describe a first space that contains gas at a reduced gas pressure relative to the gas pressure of a second space. If the first space and the second space are connected together, this pressure differential will cause gas from the second space to move towards the first space until the pressure differential is eliminated.

Vent: As used in this disclosure, a vent is an opening in a structure that allows for the flow of gas through the boundary of the structure.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 4 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A dual compartment drinking vessel comprising a plurality of bottles, an exterior housing, and a strap structure;

wherein the exterior housing contains the plurality of bottles;

wherein the strap structure attaches to the exterior housing;

wherein the plurality of bottles comprises a first bottle and a second bottle;

wherein the first bottle comprises a first flask, a first cap structure, and a first vent;

wherein the second bottle comprises a second flask, a second cap structure, and a second vent;

wherein the first flask is a fluid impermeable pan structure;

wherein the first flask forms the containment structure of the first bottle;

wherein the first flask contains the first beverage within the first bottle;

wherein the first flask further comprises a first neck, a first closed congruent end, and a first lateral face structure; wherein the first neck is the structure that forms the open face of the pan structure of the first flask;

wherein the first cap structure inserts into the first flask through the first neck;

wherein the first beverage enters the first flask through the first neck;

wherein the first closed congruent end is the closed face of the pan structure of the first flask;

wherein the first closed congruent end forms a portion of the containment surfaces that contain the first beverage within the first flask;

wherein the first lateral face structure is the lateral face structure of the first flask;

wherein the first lateral face structure forms the balance of the containment surfaces that contain the first beverage within the first flask;

wherein the first cap structure is a sealing structure;

wherein the first cap structure encloses the first neck of the first flask;

wherein the first cap structure forms a fluid transport device that allows the first beverage to be dispensed from the first flask through suction;

wherein the first cap structure further comprises a first straw;

wherein the first cap structure forms a bottle cap that encloses the first neck of the first flask;

wherein the first cap structure attaches to the first neck using a threaded connection;

wherein the first straw is a flexible tubular structure;

wherein the first straw attaches to the first cap structure;

wherein the first straw inserts through the first cap structure;

wherein the first straw forms a fluidic connection between the first beverage contained in the first flask and the exterior of the dual compartment drinking vessel;

wherein the first straw forms a fluid transport device that allows the first beverage to be drawn out of the first flask for consumption;

wherein an externally provided suction provides the motive force that draws the first beverage through the first straw;

wherein the first vent is a fluid port;

wherein the first vent forms a fluidic connection between the interior containment space of the first flask and the exterior atmosphere;

wherein the first vent equalizes the pressure between the external atmosphere and the gas contained in the first flask to prevent a pressure differential that could lock the first beverage within the first bottle.

2. The dual compartment drinking vessel according to claim 1 wherein the dual compartment drinking vessel is configured for use with a plurality of beverages;

wherein the dual compartment drinking vessel contains the plurality of beverages.

3. The dual compartment drinking vessel according to claim 2 wherein the plurality of bottles contains the plurality of beverages;

wherein each bottle selected from the plurality of bottles is a segregated structure;

wherein each beverage selected from the plurality of beverages is contained in a bottle selected from the plurality of bottles;

wherein each bottle selected from the plurality of bottles is an isolated structure that isolates the beverage contained in the selected bottle from the beverages remaining in the plurality of beverages;

wherein each bottle selected from the plurality of bottles is an insulating structure that prevents the transfer of heat between any two beverages selected from the plurality of beverages.

4. The dual compartment drinking vessel according to claim 3 wherein the exterior housing is a rigid structure;

wherein the exterior housing contains and encloses the plurality of bottles;

wherein the strap structure attaches to the exterior surface of the exterior housing;

wherein the strap structure forms a handle used to carry the dual compartment drinking vessel.

5. The dual compartment drinking vessel according to claim 4 wherein the exterior housing prevents the exchange of heat between the environment surrounding the exterior housing and the plurality of beverages contained within the plurality of bottles.

6. The dual compartment drinking vessel according to claim 5 wherein the plurality of bottles forms the containment structure that stores the plurality of beverages;

wherein each bottle selected from the plurality of bottles is a fluid impermeable structure;

wherein each selected bottle contains a beverage selected from the plurality of beverages;

wherein each selected bottle isolates its associated selected beverage from the beverages remaining in the plurality of beverages;

wherein each bottle selected from the plurality of bottles inhibits the exchange of heat between any two beverages selected from the plurality of beverages.

7. The dual compartment drinking vessel according to claim 6 wherein the first bottle contains a first beverage selected from the plurality of beverages;

wherein the second bottle contains the second beverage selected from the plurality of beverages.

8. The dual compartment drinking vessel according to claim 7 wherein the first bottle is a fluid containment structure selected from the plurality of bottles;

wherein the first bottle is a fluid impermeable structure;

wherein the first bottle is a prism shaped structure;

wherein the first bottle is an isolating structure that isolates the first beverage from a second beverage contained in the second bottle;

wherein the first bottle prevents the exchange of heat between the first beverage contained in the first bottle and the second beverage contained in the second bottle;

wherein the first bottle attaches to the second bottle to form a single lateral prism structure.

9. The dual compartment drinking vessel according to claim 8 wherein the second bottle is a fluid containment structure selected from the plurality of bottles;

wherein the second bottle is a fluid impermeable structure;

wherein the second bottle is a prism shaped structure;

wherein the second bottle is an isolating structure that isolates the second beverage from the first beverage contained in the first bottle;

wherein the second bottle prevents the exchange of heat between the second beverage contained in the second bottle and the first beverage contained in the first bottle.

10. The dual compartment drinking vessel according to claim 9 wherein the second bottle attaches to the first bottle to form a single lateral prism structure.

11. The dual compartment drinking vessel according to claim 10 wherein the first cap structure attaches to the first flask;

wherein the first vent is formed in the first flask.

12. The dual compartment drinking vessel according to claim 11 wherein the second cap structure attaches to the second flask;

wherein the second vent is formed in the second flask.

13. The dual compartment drinking vessel according to claim 12 wherein the second flask is a pan structure;

wherein the second flask is a fluid impermeable structure;

wherein the second flask forms the containment structure of the second bottle;

wherein the second flask contains the second beverage within the second bottle;

wherein the second flask further comprises a second neck, a second closed congruent end, and a second lateral face structure;

wherein the second neck is the structure that forms the open face of the pan structure of the second flask;

wherein the second cap structure inserts into the second flask through the second neck;

wherein the second beverage enters the second flask through the second neck;

wherein the second closed congruent end is the closed face of the pan structure of the second flask;

wherein the second closed congruent end forms a portion of the containment surfaces that contain the first beverage within the second flask;

wherein the second lateral face structure is the lateral face structure of the second flask;

wherein the second lateral face structure forms the balance of the containment surfaces that contain the second beverage within the second flask;

wherein the second lateral face structure attaches to the first lateral face structure to form the lateral prism structure of the plurality of bottles;

wherein the second cap structure is sealing structure;

wherein the second cap structure encloses the second neck of the second flask;

wherein the second cap structure forms a fluid transport device that allows the second beverage to be dispensed from the second flask through suction;

wherein the second cap structure further comprises a second cap structure and a second straw;

wherein the second cap structure forms a bottle cap that encloses the second neck of the second flask;

wherein the second cap structure attaches to the second neck using a threaded connection;

wherein the second straw is a flexible tubular structure;

wherein the second straw attaches to the second cap structure;

wherein the second straw inserts through the second cap structure;

wherein the second straw forms a fluidic connection between the second beverage contained in the second flask and the exterior of the dual compartment drinking vessel;

wherein the second straw forms a fluid transport device that allows the second beverage to be drawn out of the second flask for consumption;

wherein an externally provided suction provides the motive force that draws the second beverage through the second straw;

wherein the second vent is a fluid port;

wherein the second vent forms a fluidic connection between the interior containment space of the second flask and the exterior atmosphere;

wherein the second vent equalizes the pressure between the external atmosphere and the gas contained in the second flask to prevent a pressure differential that could lock the second beverage within the second bottle.

* * * * *